US011248328B2

(12) United States Patent
Yang

(10) Patent No.: US 11,248,328 B2
(45) Date of Patent: Feb. 15, 2022

(54) PORTABLE DEVICE FOR WASHING AND SPIN-DRYING LAUNDRY

(71) Applicant: Edward Yang, Hsinchu (TW)

(72) Inventor: Edward Yang, Hsinchu (TW)

( * ) Notice: Subject to any disclaimer, the term of this patent is extended or adjusted under 35 U.S.C. 154(b) by 51 days.

(21) Appl. No.: 16/782,373

(22) Filed: Feb. 5, 2020

(65) Prior Publication Data

US 2021/0238788 A1 Aug. 5, 2021

(51) Int. Cl.

| | |
|---|---|
| ***D06F 37/24*** | (2006.01) |
| ***D06F 23/04*** | (2006.01) |
| ***D06F 49/06*** | (2006.01) |
| ***D06F 37/30*** | (2020.01) |
| ***D06F 5/00*** | (2006.01) |
| ***D06F 37/12*** | (2006.01) |
| ***D06F 95/00*** | (2006.01) |

(52) U.S. Cl.

CPC ..... *D06F 37/24* (2013.01); *D06F 5/00* (2013.01); *D06F 23/04* (2013.01); *D06F 37/12* (2013.01); *D06F 37/30* (2013.01); *D06F 49/06* (2013.01); *D06F 95/006* (2013.01)

(58) Field of Classification Search

None

See application file for complete search history.

(56) References Cited

U.S. PATENT DOCUMENTS 2,285,547 A * 6/1942 Whelan ..... D06F 95/006 210/237
2018/0237970 A1* 8/2018 Nakano ..... D06F 37/266

* cited by examiner

*Primary Examiner* — Cristi J Tate-Sims

(74) *Attorney, Agent, or Firm* — Muncy, Geissler, Olds & Lowe, P.C.

(57) ABSTRACT

A portable device for washing and spin-drying laundry, comprising a cover and a bag body, wherein the cover is provided with a rotating disk, and a user can rotate the rotating disk through a grip provided on the rotating disk, so that the rotating disk is rotated relative to the cover. A storage bag is connected at the bottom of the rotating disk, which can be used to store the laundry to be washed. The bag body is mainly made of soft material and can be folded for storage. An opening is formed for the cover to be assembled. When the present disclosure is used, the laundry to be washed is first placed in the storage bag, then the storage bag can be connected to the cover, and finally the cover can be combined with the bag body. Thereafter, the user holds the grip to turn the rotating disk such that the storage bag rotates inside the bag body to perform the washing and spin-drying operations. Moreover, the bag body can be folded for storage, so that the present disclosure can achieve the purpose of being convenient to carry and use.

9 Claims, 9 Drawing Sheets

PORTABLE DEVICE FOR WASHING AND SPIN-DRYING LAUNDRY

BACKGROUND OF INVENTION

(1) Field of the Invention

The present disclosure relates to a portable device for washing and spin-drying laundry, more particularly to a portable device for washing and spin-drying laundry which is convenient to carry.

(2) Brief Description of Related Art

Generally, the household washing machine has a large capacity. The normal washing capacity lies between 10 and 13 liters. As a result, it is usually more economical to accumulate a considerable amount of clothes to be washed together. However, for intimate clothes, socks, handkerchiefs or delicate clothes that need to be washed by hand, it is required to wash them daily. Therefore, mini-type washing machines appear on the market to meet such needs. However, most mini-type washing machines require electric equipment such as a motor and a power source. They cannot be used without power. Moreover, the environment in which mini-type washing machines are used is mostly in humid conditions, such as bathrooms, which also easily lead to the risk of leakage. In addition, in order to meet the needs of going out, such as mountain-climbing, camping, and other outdoor activities, manual type washing machines without electricity were developed. The manual type washing machine only needs to be operated manually to wash clothes. However, the manual type washing machine mainly uses manual rotation to wash clothes by making use of centrifugal force, but the structure of the manual type washing machine is still too complicated and not lightweight enough. Meanwhile, most mini-type washing machines must be equipped with a fixed-shaped outer housing, such as a washing tub. In this way, such washing machines are not easy to carry. Therefore, the development of an energy-saving and carbon-reducing product with a simple, lightweight and portable structure is the subject of the present invention.

SUMMARY OF INVENTION

Therefore, it is a primary object of the present disclosure to provide a portable device for washing and spin-drying laundry which can perform the washing and spin-drying operations manually and is convenient to carry.

According to the present disclosure, a portable device for washing and spin-drying laundry includes a cover and a bag body. The cover is provided with a rotating disk. A user can rotate the rotating disk through a grip provided on the rotating disk, so that the rotating disk can be rotated relative to the cover. A storage bag is connected at the bottom of the rotating disk, which can be used to store the laundry to be washed. The bag body is mainly made of soft material and can be folded for storage. An opening of the bag body is formed for the cover to be assembled. When the present disclosure is used, the laundry to be washed is first placed in the storage bag, then the storage bag is connected to the cover, and finally the cover is combined with the bag body. Thereafter, the user holds the grip to turn the rotating disk such that the storage bag rotates inside the bag body to perform the washing and spin-drying operations. Moreover, the bag body can be folded for storage, so that the present disclosure can achieve the purpose of being convenient to carry and use.

DETAILED DESCRIPTION OF PREFERRED EMBODIMENTS

To make it easier for our examiner to understand the objective of the present disclosure, its features, and advantages, we use a preferred embodiment together with the attached drawings for the detailed description of the disclosure.

Figure 1:
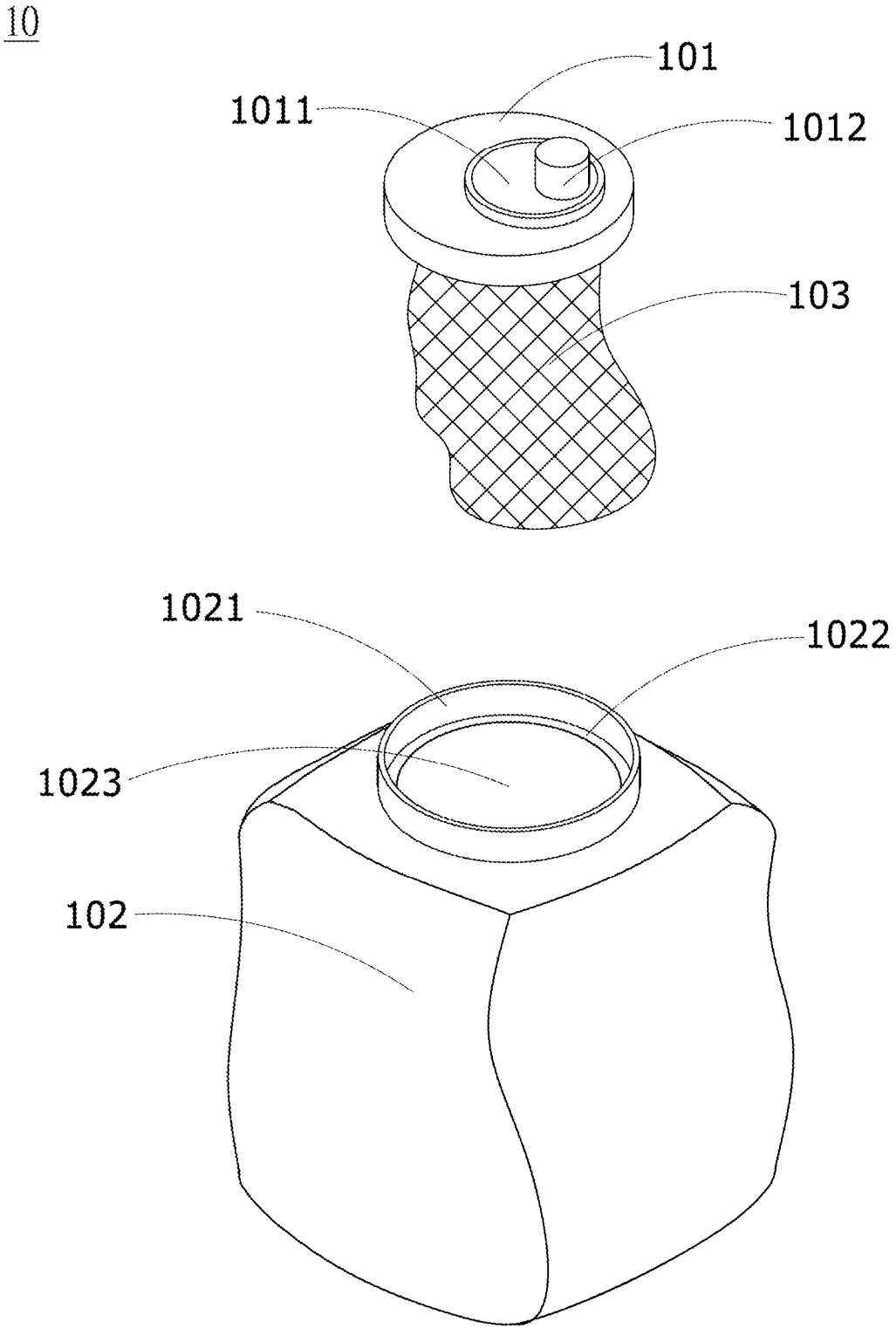
FIG. 1 is a perspective view of the structure and the configuration of a first embodiment of the present disclosure.

With reference to FIG. 1, a portable device 10 for washing and spin-drying laundry according to the present disclosure comprises a cover 101 and a bag body 102. The cover 101 is in the shape of a disk. A rotating disk 1011 is movably assembled on the cover 101. A grip 1012 is provided on the rotating disk 1011. The grip 1012 can drive the rotating disk 1011 to rotate relative to the cover 101. A storage bag 103 can be hung under the rotating disk 1011. The storage bag 103 is a grid-shaped bag, which can be used to store laundry to be washed. The bag body 102 is mainly made of soft materials, such as PET (polyethylene terephthalate), PP (Polypropylene), NYLON (nylon) and other soft plastic materials. Since the bag body 102 is made of the soft material, it can be folded and stored in a normal state to reduce the volume of the bag body 102. An accommodation space 1023 is formed inside the bag body 102 for storing washing water. An opening 1021 is provided at one end of the bag body 102. Meanwhile, the opening 1021 is in communication with the accommodation space 1023 inside the bag body 102. An abutting portion 1022 is formed near the inner edge of the opening 1021, and the abutting portion 1022 can be combined with the cover 101.

Figure 2:
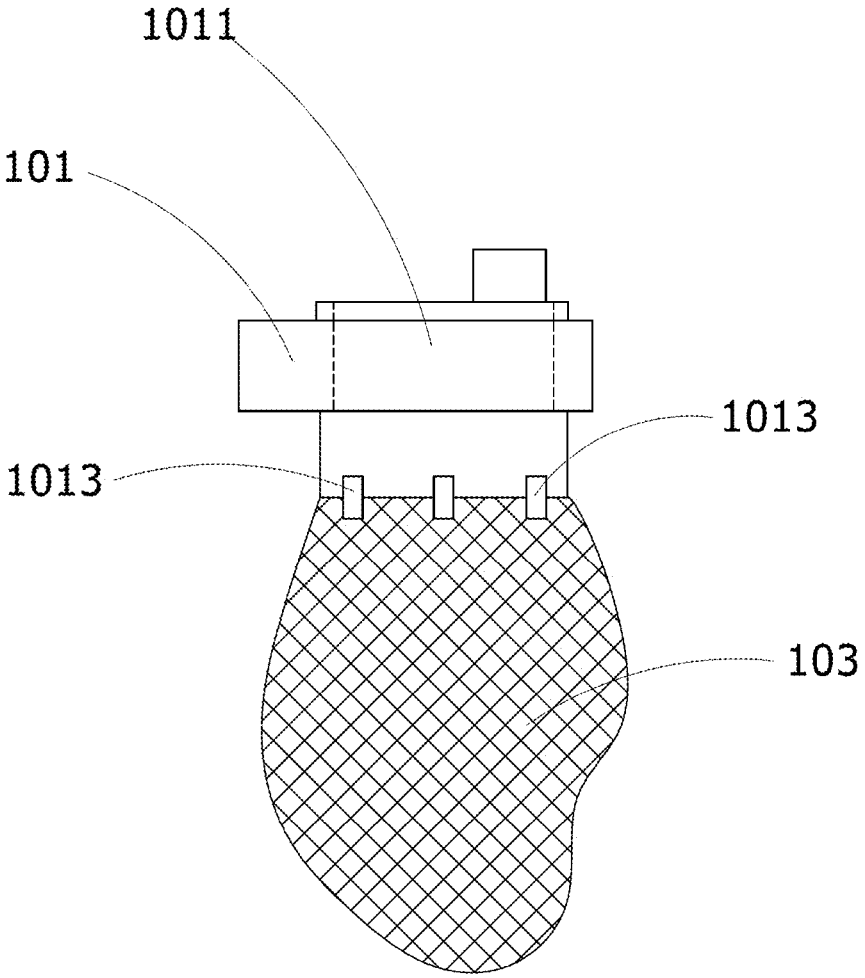
FIG. 2 is a schematic view of the structure and the configuration of the first embodiment of the present disclosure.

Referring to FIG. 2, the cover 101 shown in FIG. 1 is provided with a plurality of hook fasteners 1013 at the bottom of the rotating disk 1011. The hook fasteners 1013 may be fixing elements such as clamps, etc. The storage bag 103 can be hung and fixed to the bottom of the rotating disk 1011 by the hook fasteners 1013, so that the storage bag 103 can rotate with the rotating disk 1011

Figure 3:
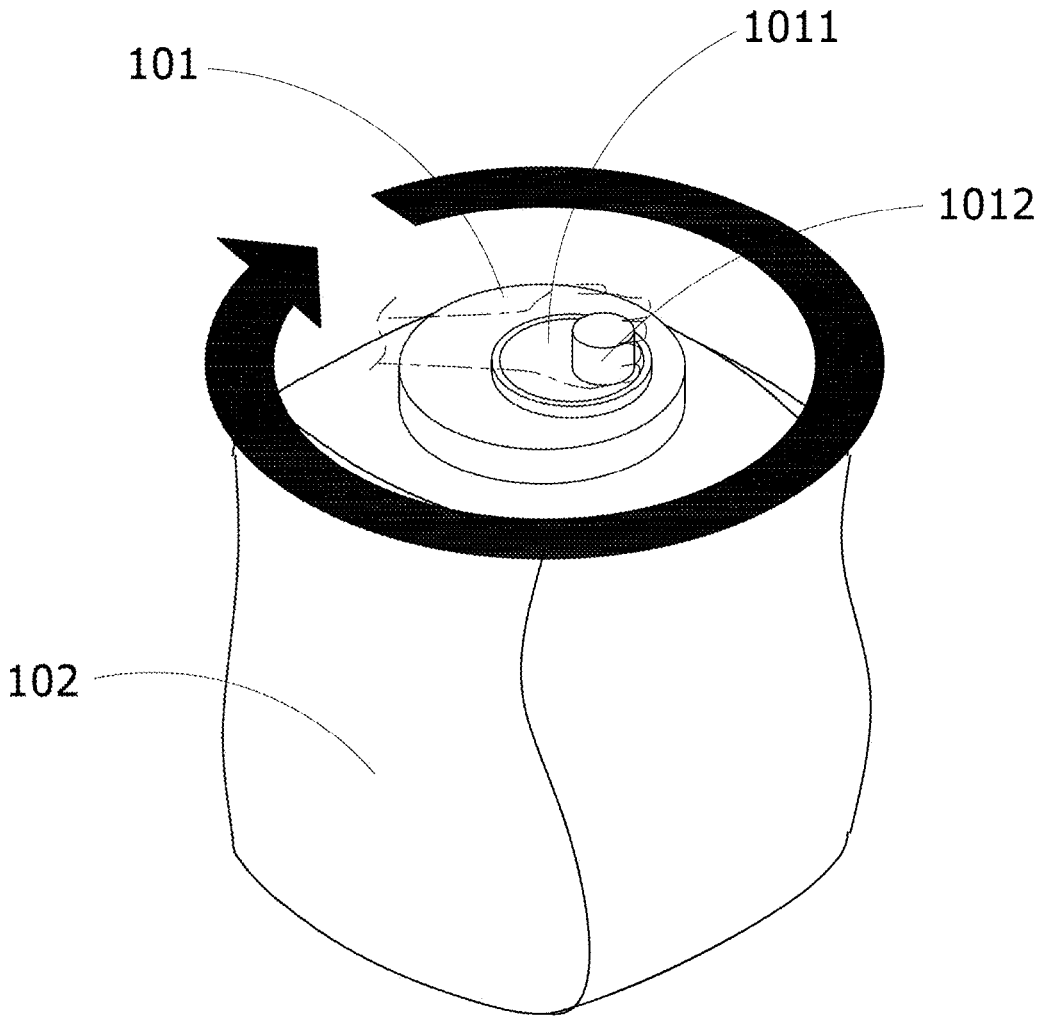
FIG. 3 is a perspective view of the operation of the first embodiment of the present disclosure.

The completed assembly of the aforementioned components is shown in FIG. 3. Referring to FIG. 1 and FIG. 2, the laundry to be washed can be placed in the storage bag 103 first. Further, the storage bag 103 can be fixed to the bottom of the rotating disk 1011 by the hook fasteners 1013. The inside of the bag body 102 is further filled with a washing liquid W. The washing liquid W is a mixture of washing products such as water, laundry detergent, and washing powder. The cover 101 is then placed onto the abutment portion 1022 of the opening 1021, so that the cover 101 and the bag body 102 can be combined. In this way, the user can further hold the grip 1012 of the cover 101 with his hand and rotate it clockwise or counterclockwise, so that the rotating disk 1011 can rotate clockwise or counterclockwise relative to the cover 101.

Figure 4:
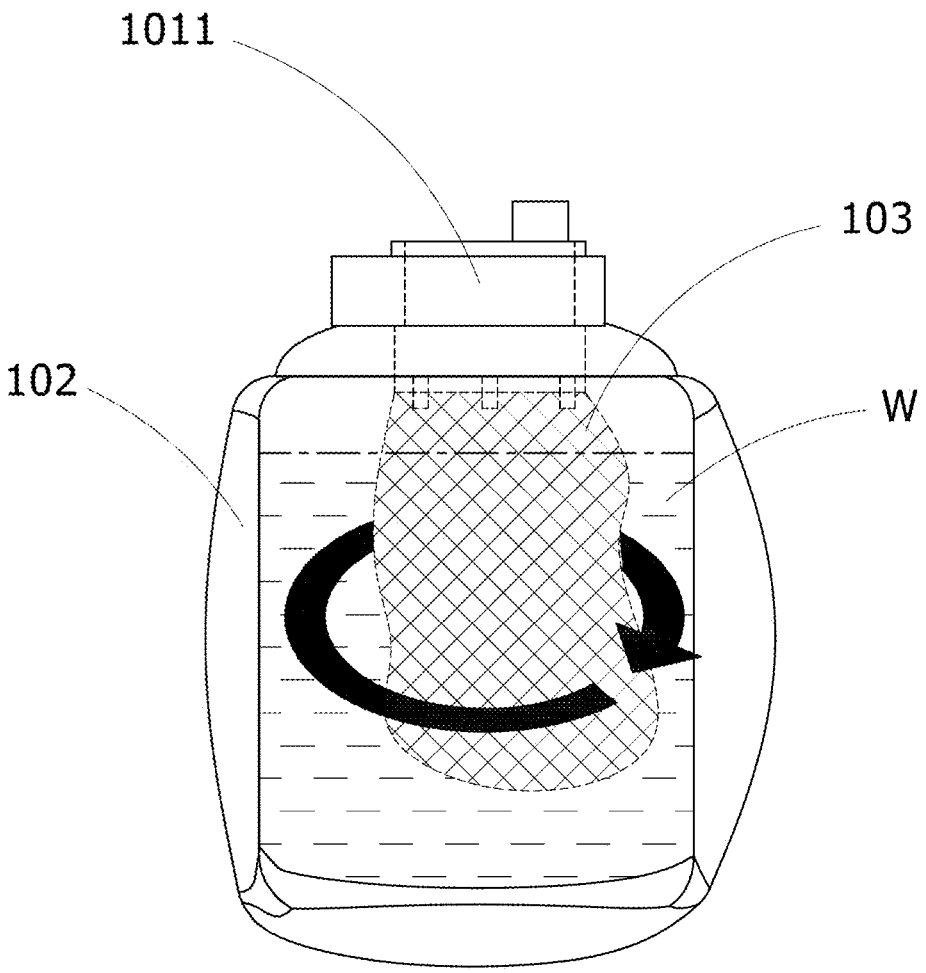
FIG. 4 is a schematic view of the operation of the first embodiment of the present disclosure.

Referring to FIG. 4 again, when the rotating disk 1011 rotates, the storage bag 103 can be driven to rotate in the washing liquid W, so that the user can complete the laundry-washing operation manually by means of the device of the present disclosure. After the user discharges the washing liquid in the bag body 102, the washed laundry is placed in the storage bag 103 and the spin-drying operation is performed by rotating the rotating disk 1011. Meanwhile, the bag body 102 is easily folded to achieve the purpose of portability.

Figure 5:
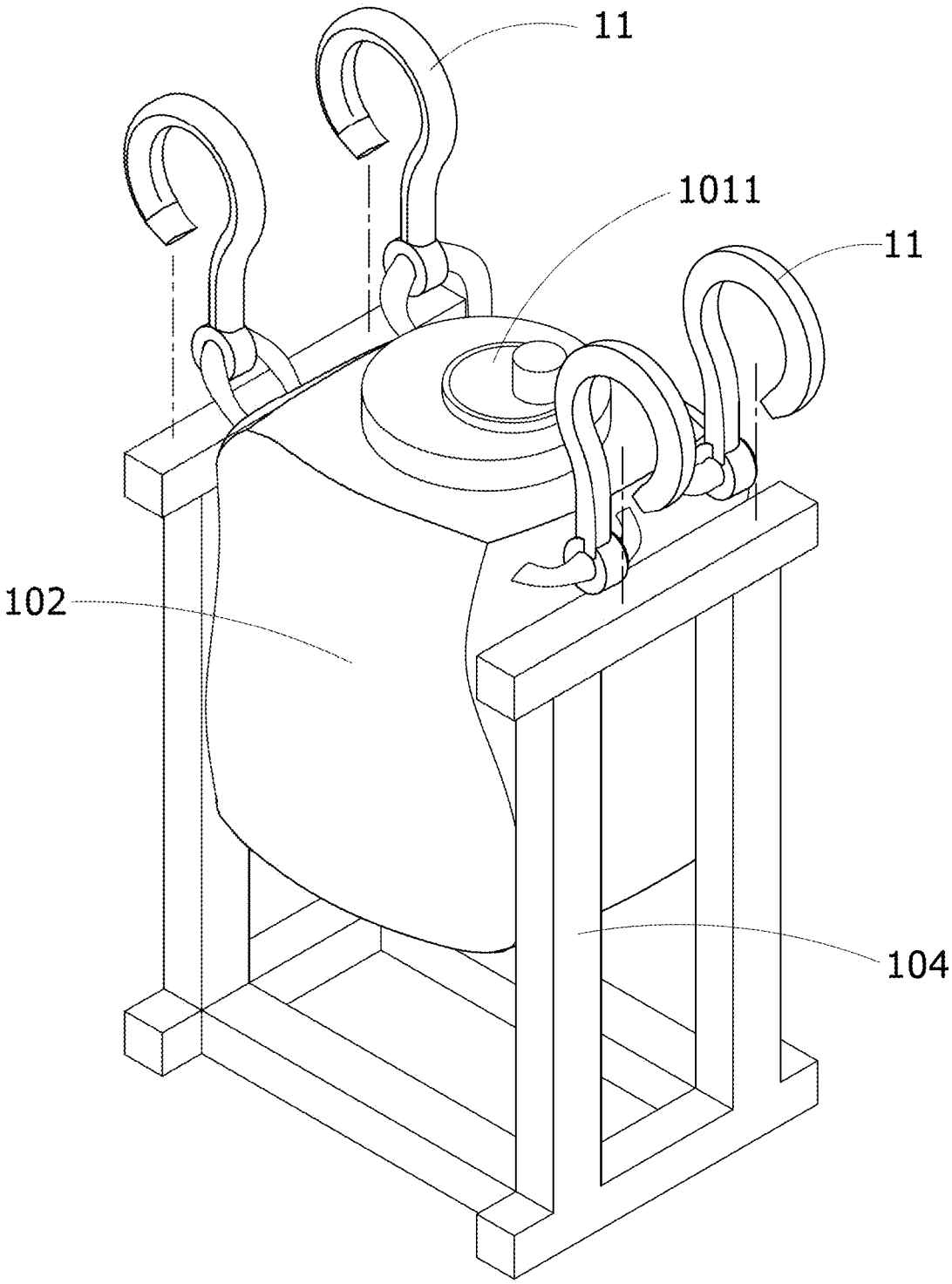
FIG. 5 is a perspective view of a second embodiment of the present disclosure.

Referring to FIG. 5, in order to further stabilize the rotating disk 1011, a plurality of hanging hooks 11 can be further provided on the outside of the bag body 102. The hanging hooks 11 can be hung on a support frame 104. In other words, the support frame 104 is provided for the hanging hooks 11, so that the bag body 102 can be hung on the support frame 104 through the hanging hooks 11. When the bag body 102 is hung on the support frame 104 through the hanging hooks 11, the bag body 102 can be placed in a standing position, so that when the user rotates the rotating disk 1011 by force, a stable support can be achieved by means that the bag body 102 is hung on the support frame 104 by the hanging hooks 11.

Figure 6:
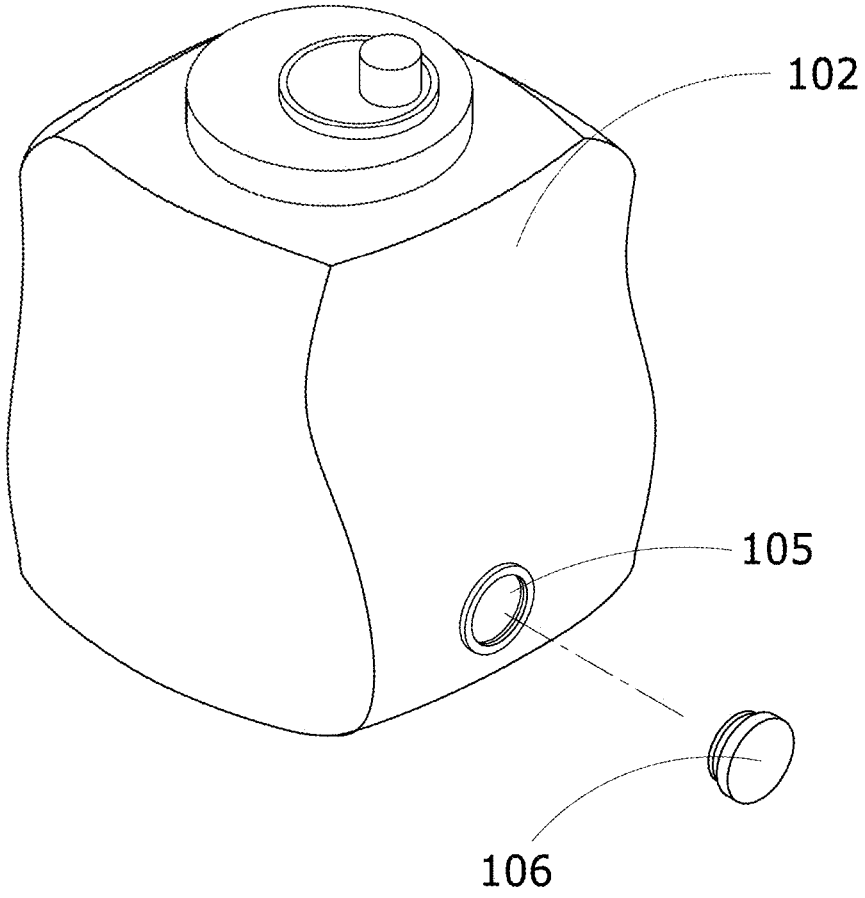
FIG. 6 is a perspective view of a third embodiment of the present disclosure.

Referring to FIG. 6, a drain hole 105 can be formed on the outside of the bag body 102. The drain hole 105 is in communication with the interior of the bag body 102. A screw cap 106 can be screwed in the drain hole 105. When the water in the bag body 102 is to be discharged, the screw cap 106 can be unscrewed to allow the water to flow out of the drain hole 105 to facilitate drainage. After the drainage is completed, the screw cap 106 is screwed on again so that the accommodation space 1023 inside the bag body 102 is closed.

Figure 7:
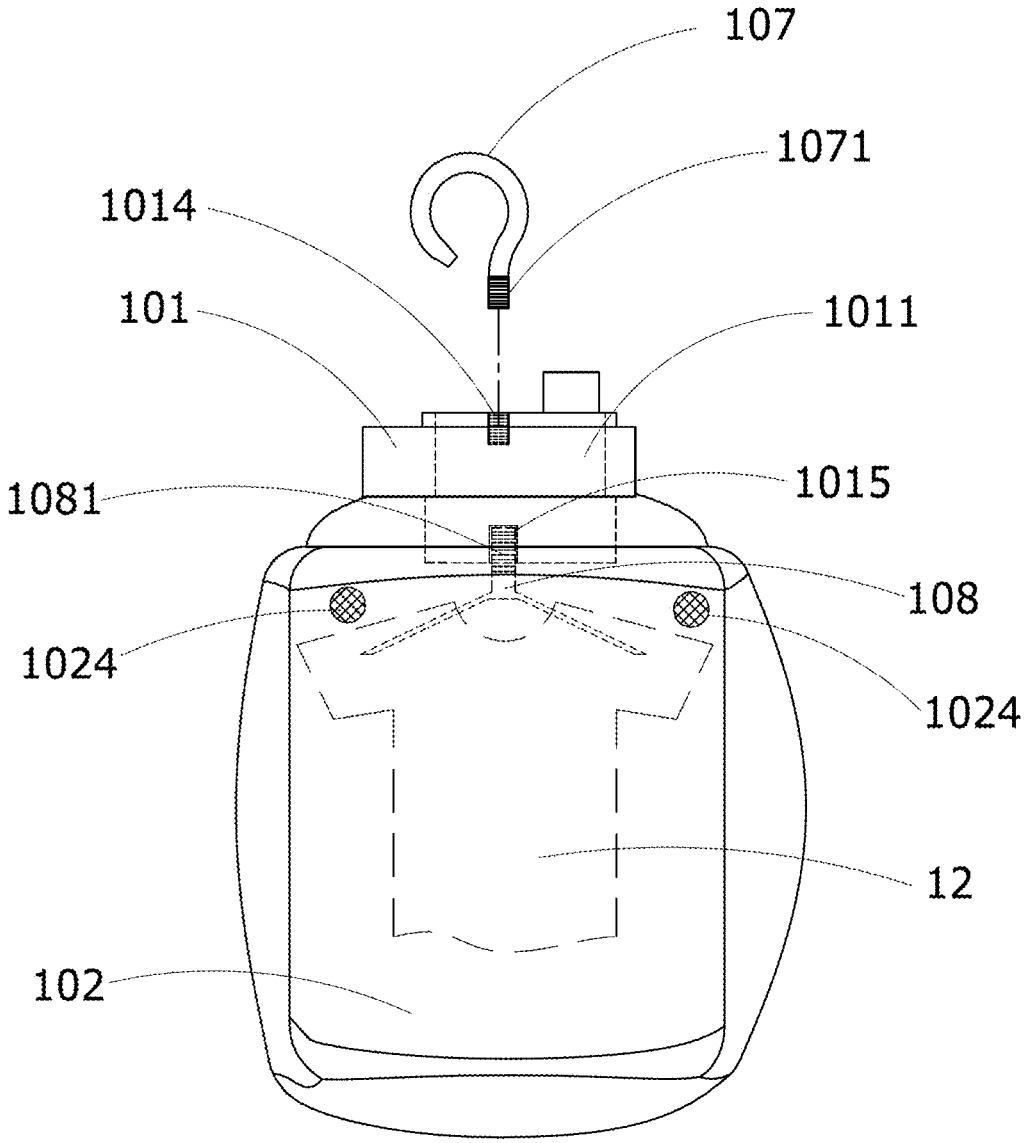
FIG. 7 is a perspective view of a fourth embodiment of the present disclosure.

Referring to FIG. 7, a first screw hole 1014 and a second screw hole 1015 are respectively formed on the top and the bottom of the rotating disk 1011 of the cover 101. The first screw hole 1014 and the second screw hole 1015 can be provided for screwing a first hanging piece 107 and a second hanging piece 108 thereinto respectively. The first hanging piece 107 can be a hook, which can be screwed into the first screw hole 1014 through a first screwing portion 1071 formed at one end thereof. The second hanging piece 108 can be a hanger, which can be screwed with the second screw hole 1015 through a second screwing portion 1081 formed at one end thereof. After the first hanging piece 107 and the second hanging piece 108 are respectively fitted to the rotating disk 1011 of the cover 101, the laundry 12 can be hung through the second hanging piece 108 and placed in the bag body 102, while the first hanging piece 107 can be hung on, for example, a tree, etc. Thereby, the laundry hung on the second hanging piece 108 can be air-dried after the first hanging piece 107 is hung on a high place. Moreover, the bag can further be formed with a plurality of through-holes 1024 on the outside thereof to accelerate the spin-drying speed of the laundry.

Figure 8:
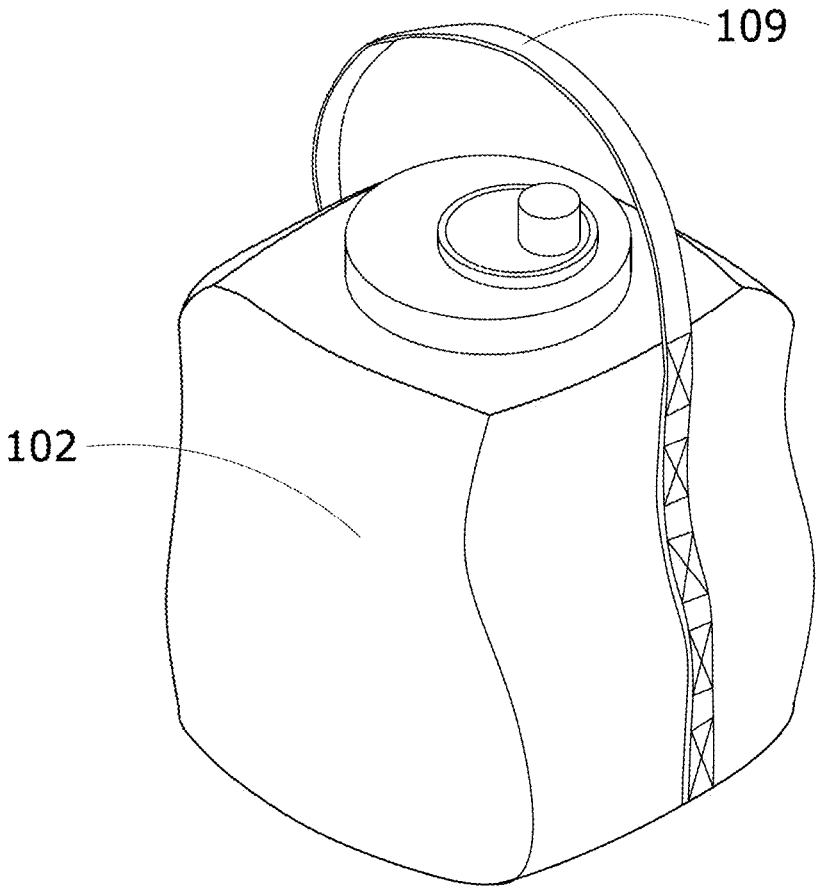
FIG. 8 is a perspective view of a fifth embodiment of the present disclosure.

Referring to FIG. 8, for the carrying convenience, the bag body 102 can be provided with a strap 109 on the outside thereof, through which the bag body 102 can be carried on the body of the user, or directly carried by the hand. It is also possible to increase the stability of the bag body 102 by holding the strap 109 in washing the laundry.

Figure 9:
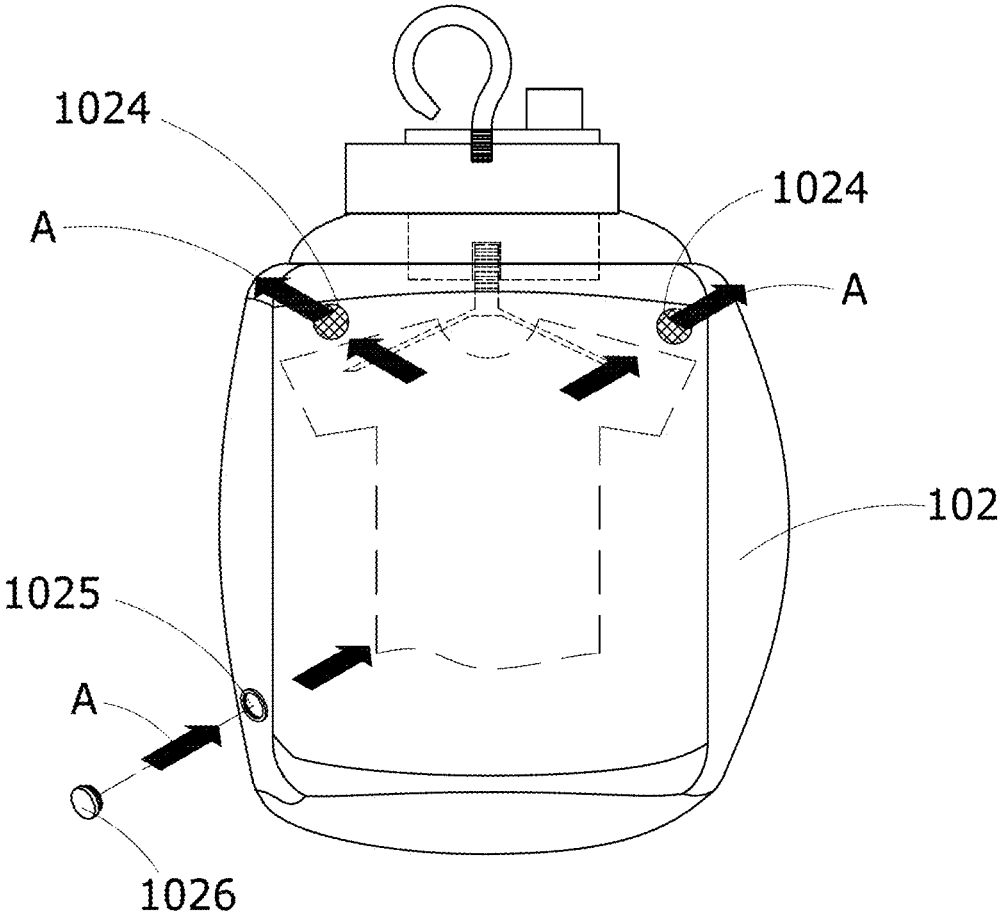
FIG. 9 is a perspective view of a sixth embodiment of the present disclosure.

Referring to FIG. 9, the outside of the bag body 102 according to FIG. 7 is formed with an air inlet hole 1025, which can be closed after being screwed on by a plug cover 1026. The air inlet hole 1025 can be accessed by outside air. For example, a hot air A generated by a blower is filled into the air inlet 1025, so that the laundry inside the bag body 102 can be dried by the hot air A. In addition, the hot air A can be further discharged through a plurality of through-holes 1024.

In summation, the portable device for washing and spin-drying laundry according to the present disclosure has a bag body 102 mainly made of soft material and can be folded for easy storage. The user can hold the grip to rotate the rotating disk 1011 so that the storage bag 103 is rotated inside the bag body 102 to achieve the effect of washing and spin-drying laundry. In this way, the portable device for washing and spin-drying laundry according to the present disclosure can indeed achieve the laundry-washing and spin-drying effect in a manual manner. Meanwhile, it is convenient to carry outside.

While the present disclosure has been described by preferred embodiments in conjunction with accompanying drawings, it should be understood that the embodiments and the drawings are merely for descriptive and illustrative purpose, not intended for restriction of the scope of the present disclosure. Equivalent variations and modifications performed by person skilled in the art without departing from the spirit and scope of the present disclosure should be considered to be still within the scope of the present disclosure.

What is claimed is:

1. A portable device for washing and spin-drying laundry, comprising:

a cover having a rotating disk, the top and bottom of the rotating disk being respectively provided with a grip and a plurality of hook fasteners;

a storage bag hung and fixed to the bottom of the rotating disk through the hook fasteners, the storage bag is provided for storing laundry to be washed or spun;

a bag body made of soft materials, the bag body having an opening for the insertion of the cover, an accommodation space being formed inside the bag body, the opening being in communication with the accommodation space; and a first screw hole and a second screw hole respectively formed on the top and the bottom of the rotating disk of the cover, the first screw hole and the second screw hole being configured to be provided for screwing a first hanging piece and a second hanging piece thereinto respectively, wherein a washing liquid is configured to be injected into the accommodating space of the bag body for soaking the storage bag in the accommodation space after the cover is fitted into the opening, the rotating disk is configured to be rotated by the grip for rotating the storage bag in the washing liquid to perform the washing operation, and wherein, after the washing liquid in the accommodating space is poured out, the rotating disk is configured to be rotated by the grip again to perform the spin-drying operation for the laundry.

2. The portable device for washing and spin-drying laundry as recited in claim 1, wherein an abutting portion is formed at the inner edge of the opening.

3. The portable device for washing and spin-drying laundry as recited in claim 1, wherein a plurality of hanging hooks is provided on the outside of the bag body, and wherein the bag body is configured to be hung on the support frame by means of the hanging hooks.

4. The portable device for washing and spin-drying laundry as recited in claim 1, wherein a drain hole is formed on the outside of the bag body, and wherein a screw cap is configured to be screwed in the drain hole.

5. The portable device for washing and spin-drying laundry as recited in claim 1, wherein the first hanging piece is a hook, and wherein a first screwing portion is formed at one end of the first hanging piece.

6. The portable device for washing and spin-drying laundry as recited in claim 1, wherein the second hanging piece is a hanger, and wherein a second screwing portion is formed at one end of the second hanging piece.

7. The portable device for washing and spin-drying laundry as recited in claim 1, wherein the bag is formed with a plurality of through-holes on the outside thereof.

8. The portable device for washing and spin-drying laundry as recited in claim 7, wherein the outside of the bag body is formed with an air inlet hole, which can be closed after being screwed on by a plug cover.

9. The portable device for washing and spin-drying laundry as recited in claim 1, wherein the outside of the bag body is provided with a strap.

* * * * *